United States Patent [19]

Szabo et al.

[11] 4,279,224

[45] Jul. 21, 1981

[54] CONVERTIBLE INTAKE MANIFOLD

[76] Inventors: Robert C. Szabo; Peter J. Incaudo, Jr., both of 13505 Shoup Ave., Hawthorne, Calif. 90250

[21] Appl. No.: 77,452

[22] Filed: Sep. 20, 1979

[51] Int. Cl.[3] ..... F02B 75/22

[52] U.S. Cl. ..... 123/52 MV; 123/52 M; 123/52 MC; 123/55 VE

[58] Field of Search ..... 123/52 MV, 52 M, 52 MC, 123/55 VE, 55 VS, 55 VF, 55 V, 193 H, 195 A, 195 C

[56] References Cited

U.S. PATENT DOCUMENTS

| | | | |
|---|---|---|---|
| 2,991,774 | 7/1961 | Rarey | 123/52 VE |
| 2,991,778 | 7/1961 | Kolbe | 123/55 VE |
| 3,561,408 | 2/1971 | Weiand | 123/52 MV |
| 3,744,463 | 7/1973 | McFarland | 123/52 MV |
| 3,831,566 | 8/1974 | Thomas | 123/52 MV |
| 3,931,811 | 1/1976 | McFarland | 123/52 MV |
| 3,994,129 | 11/1976 | Sakurai | 123/52 MV |
| 4,210,107 | 7/1980 | Shaffer | 123/52 MV |

*Primary Examiner*—Charles J. Myhre

*Assistant Examiner*—Carl Stuart Miller

*Attorney, Agent, or Firm*—Nilsson, Robbins, Dalgarn, Berliner, Carson & Wurst

[57] ABSTRACT

A convertible intake manifold for a V-block engine has a base member and an interchangeable center runner member isolated therefrom. The base member has a coolant crossover section at one end; a distributor boss section at a second end opposite the one end; an engine valley cover section between the coolant crossover section and the distributor boss section; and a pair of port sealing sections, one on either side of the engine valley cover section between the coolant crossover section and the distributor boss section. The port sealing sections have a thickness equal to or less than the thickness of the remaining base member sections for allowing maximum flexibility in selecting a runner configuration for the center runner member. The center runner member may have any runner configuration with runner mating faces configured to be interchangeably attached to the V-block engine without removing the base member.

6 Claims, 4 Drawing Figures

CONVERTIBLE INTAKE MANIFOLD

BACKGROUND OF THE INVENTION

The present invention relates to intake manifolds and in particular to an intake manifold having an interchangeable center runner section.

Conventional intake manifolds used on V-block engines having dual cylinder bands are generally multipurpose apparatus which include a coolant crossover section through which coolant is transferred from each engine cylinder bank to the centrally located thermostat outlet; a distributor boss on which the engine distributor is mounted; a center plate section for covering and sealing the engine valley between the cylinder banks to keep contamination from the engine's interior parts and to prevent the escape of pollutants into the atmosphere; a thermostat outlet housing; and a center runer apparatus coupling the carburetor to the intake ports of the cylinder transferring fuel and air from the carburetor to the cylinders. In order to alter the runner configuraton and carburetion of a conventional intake manifold, it is necessary to replace the entire intake manifold. Such a replacement requires the following steps:

1. draining the engine coolant, to prevent spillage into the engine valley;
2. removing all ignition wires;
3. disconnecting and removing the distributor cap and the distributor;
4. disconnecting the coolant hoses and the thermostat housing;
5. disconnecting the fuel lines and carburetor linkages;
6. removing the various brackets attached to the intake manifold including the steering columnar bracket, the alternator-generator bracket, the air conditioner brackets and, if present, the coil bracket;
7. loosen and remove all bolts attaching the intake manifold;
8. pry manifold off;
9. clean all surfaces, replacing all gaskets and then reversing the above steps.

The above procedure has at least two distinct disadvantages over and above the amount of time and effort required:

Firstly, the removal of the distributor necessitates a resetting of the engine timing.

Secondly, the removal of the entire intake manifold breaks the engine valley closure causing the loss of oil and exposure of vital internal parts of the engine to contamination. The installation of a new intake manifold requires that the engine valley seal be reformed to restore the integrity of the closure. Furthermore, most of the above operations are unnecessary to the objective of providing a new runner configuration and are only required because the coolant crossover, the distributor boss, the thermostat housing and the engine valley cover are integral with the runners.

The present invention obviates the above operations when it is desired to merely change the runner configuration by providing a novel intake manifold assembly having a novel isolated base member and a removable and interchangeable center runner member mountable to the isolated base member. More specifically, the base member has an engine valley cover which covers the engine valley from front to back and side to side to maintain the required engine valley closure; a coolant crossover section with a thermostat housing; a distributor boss section on which the distributor is mounted; and two port flange sections integrally formed on either side of the engine valley cover section between the coolant crossover section and the distributor boss section. The two integral port flange sections provided in accordance with the invention, eliminate the necessity of providing edge sealing surfaces and complicated edge sealing gaskets which would otherwise be necessary between the edges of the runner member and the adjoining edges of the base member. In the preferred embodiment each port section is relatively thin so that no permanent runner extension is incorporated. This allows maximum versatility in configuring the runners. Each port section has an upper mating face. The center runner member has oppositely disposed runner mating faces each of which is positioned and held adjacent to one of the port mating faces with a gasket therebetween.

In operation, the isolated base member of the invention is bolted to the engine between the respective engine cylinder banks thereby covering and sealing the engine valley. In the preferred embodiment the base member has a lower engine mating face which is substantially identical to that of a stock intake manifold. Hence, the stock intake manifold can simply be removed from an engine and the isolated base member of the invention bolted to the engine in its place.

The base member thus includes the coolant crossover section, an engine valley cover region for maintaining closure of the engine valley section, and a distributor boss section. A center runner member having any one of a number of runner or plenum configurations may then be selected and bolted to the base member without removing it. When it is desired to change the runner or plenum configuration and the associated carburetor, it is only necessary to remove and replace the center runner member. Thus, the base member remains in place eliminating the necessity of breaking the coolant crossover seals, breaking the engine valley closure, removing the distributor from the distributor boss thereafter necessitating a retiming of the engine, and removing the thermostat outlet housing. Indeed, the runner configuration of the invention may be quickly and easily changed by merely disconnecting and reconnecting a fuel line and the carburetor linkages.

If the base member is to be made from lightweight plastic, the invention also has the advantage of being in one piece without the necessity of using a plurality of molds to make a plurality of manifold pieces which must be glued together. Such a one-piece mold is possible because the complicated runner member is separate from the base member. It is particularly desirable that the base member port sections be as thin as possible to allow maximum space and hence maximum flexibility in designing runner member.

Various prior art patents illustrate multipiece intake manifolds. For example, multipiece manifolds are shown in U.S. Pat. No. 3,831,566 filed May 31, 1973, and issued to Thomas; and U.S. Pat. No. 3,994,129, filed Dec. 30, 1974, and issued to Sakurai, et al. However, neither of these patents provides an intake manifold wherein the intake manifold runners are separable from the remaining parts of the intake manifold to provide a base member which by itself provides engine valley closure, a coolant crossover with thermostat housing and distributor mounting boss.

Also known in the prior art is the engine configuration wherein the coolant crossover section and the distributor boss section are integral with the engine block rather than the intake manifold. In such an engine, the engine valley is considerably shortened in length and is between the cylinder banks on the sides and the coolant crossover section and distributor boss section on the ends. In this configuration, the intake manifold comprises a plate for enclosing the engine valley and a runner section which may be attached to the heads of the engine. Although this configuration allows some flexibility in interchanging runners, the engine block is considerably more difficult to cast because of the complexity added by the integral coolant crossover section and integral distributor boss section.

SUMMARY OF THE INVENTION

In accordance with the present invention an intake manifold assembly is provided for replacing a stock intake manifold on an engine having a V-shaped engine block with dual cylinder banks each having an engine mating surface with a plurality of ports therein. The engine has an engine valley between the dual cylinder banks. The novel intake manifold assembly comprises at least one removable and interchangeable center runner member having a carburetor mount, the center runner member comprising a first manifold runner means having a first runner mating flange with communicating runner ports therethrough at one end remote from the carburetor mount and a second manifold runner means having a second runner mating flange with communicating runner ports at one end remote from the carburetor mount. The intake manifold assembly also comprises an isolated manifold base member with an integral coolant crossover section, a distributor boss section, and an engine valley cover section between the coolant crossover section and the distributor boss section. In addition, the manifold base member has a pair of relatively thin port section flanges on opposite sides of the engine valley cover section between the coolant crossover section and the distributor boss section, each having an upper mating face. The manifold base member further has a continuous bottom mating face for being positioned and held against the engine mating surface for interconnecting the coolant crossover sections to the engine block and enclosing the engine valley. The first and second runner mating flanges of the center runner member are configured to be positioned and held adjacent of one of the upper mating faces of the port section flanges whereby one center runner member can be replaced by a second center runner member without removing the manifold base member.

In the preferred embodiment, the coolant crossover section has a coolant crossover duct therethrough with the bottom mating face being held to the adjacent cylinder bank by a pair of first bolts extending through the manifold base member and positioned on either side of the coolant crossover duct. The distributor boss section adjacent each port section flange is held to the adjacent cylinder bank by at least one second bolt. The first and second runner mating flanges are each held against the adjacent top mating face of the port section flange by at least one centrally located third bolt through the runner mating flange and a pair of clamps positioned over the ends of each runner mating flange, one positioned adjacent the coolant crossover section and the other adjacent the distributor boss section, each clamp being held by one of the first or second bolts, or in the preferred embodiment, by a top nut on a hexed double-ended stud.

Finally, the base member port section flanges preferably have a thickness no greater than that required to maintain structural integrity of the port flange section during use. In one embodiment, the flanges are tapered with increasing thickness toward the valley cover section.

BRIEF DESCRIPTION OF THE DRAWINGS

A complete understanding of the present invention and of the above and other objects and advantages thereof may be gained from a consideration of the following description of the preferred embodiments taken in conjunction with the accompanying drawings in which.

DETAILED DESCRIPTION

Figure 1:
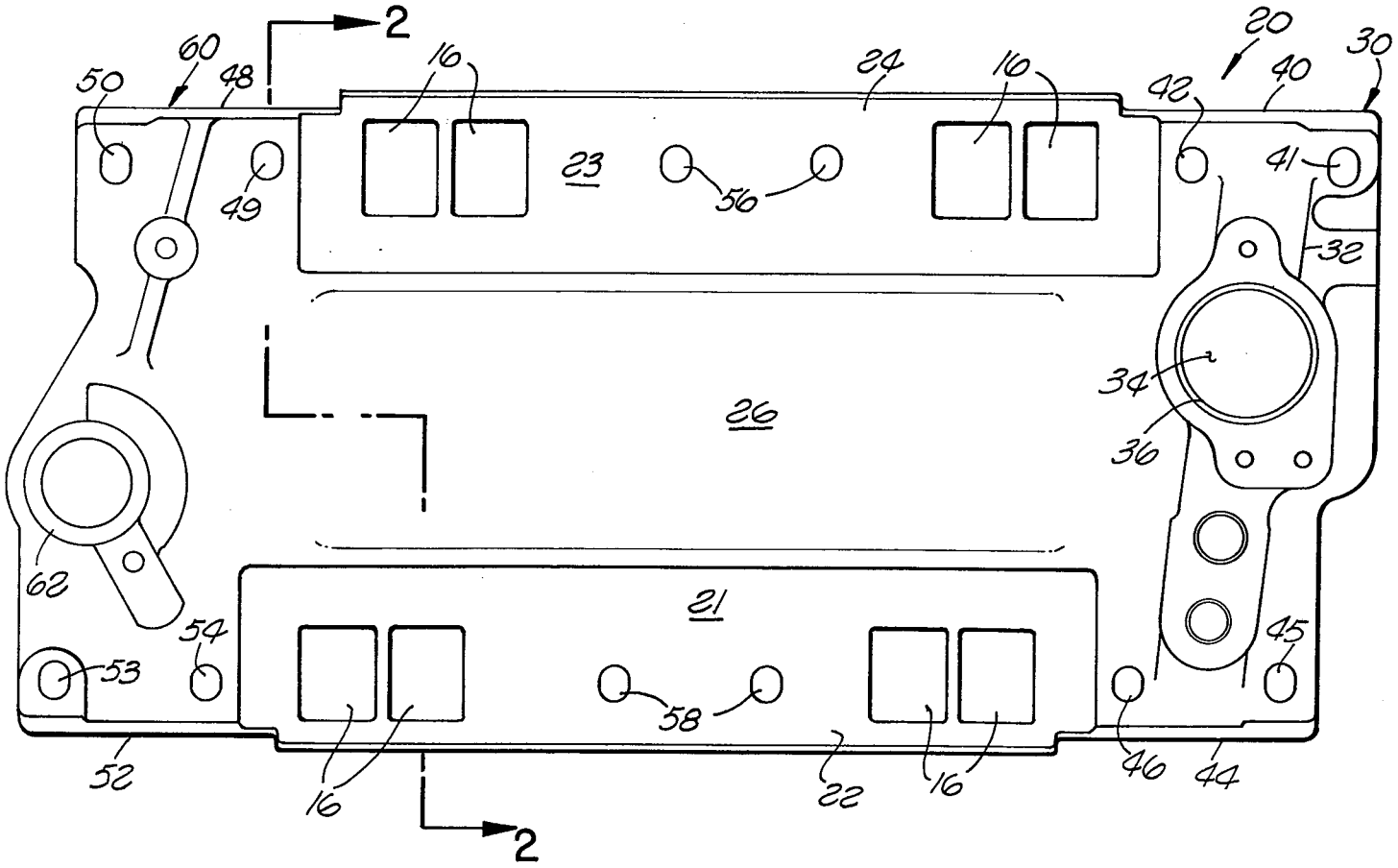
FIG. 1 is a top plan view of a manifold base member in accordance with the present invention.

Referring first to FIG. 1, an isolated manifold base member 20 in accordance with the present invention has a coolant crossover section 30 having a coolant crossover duct 32 with a centrally positioned coolant crossover outlet 34 to which a hose (not shown) is interconnected for coolant communication between an engine and a radiator. The coolant crossover section 30 also includes a thermostat outlet housing 36 extending into the interior of the coolant crossover duct 32.

The coolant crossover duct provides a passageway between a first angled mounting flange 40 and a second angled mounting flange 44. The included angle between the angled mounting flanges 40 and 44 is selected to correspond to the included angle between the respective cylinder banks of a V-block engine. Bolt holes 41 and 42 extended through the first angled mounting flange 40 on either side of the coolant crossover duct 32 and bolt holes 45 and 46 extend through the second angled mounting flange 44 on either side of the coolant crossover duct 32.

A distributor boss section 60 is positioned at the opposite end of the manifold base member 20 and comprises a distributor mounting boss 62 to which a distributor is attached. The distributor boss section 60 is held to the engine by bolts which extend through bolt holes 49 and 50 in a third angled mounting flange 48 on one side of the distributor boss section 60 and bolt holes 53 and 54 which extend through a fourth angled mounting flange 52 on the opposite side of the distributor boss section 60. The included angle between the third and fourth angled mounting flanges correpond to the included angle between the oppositely disposed cylinder bank of the engine block.

Figure 4:
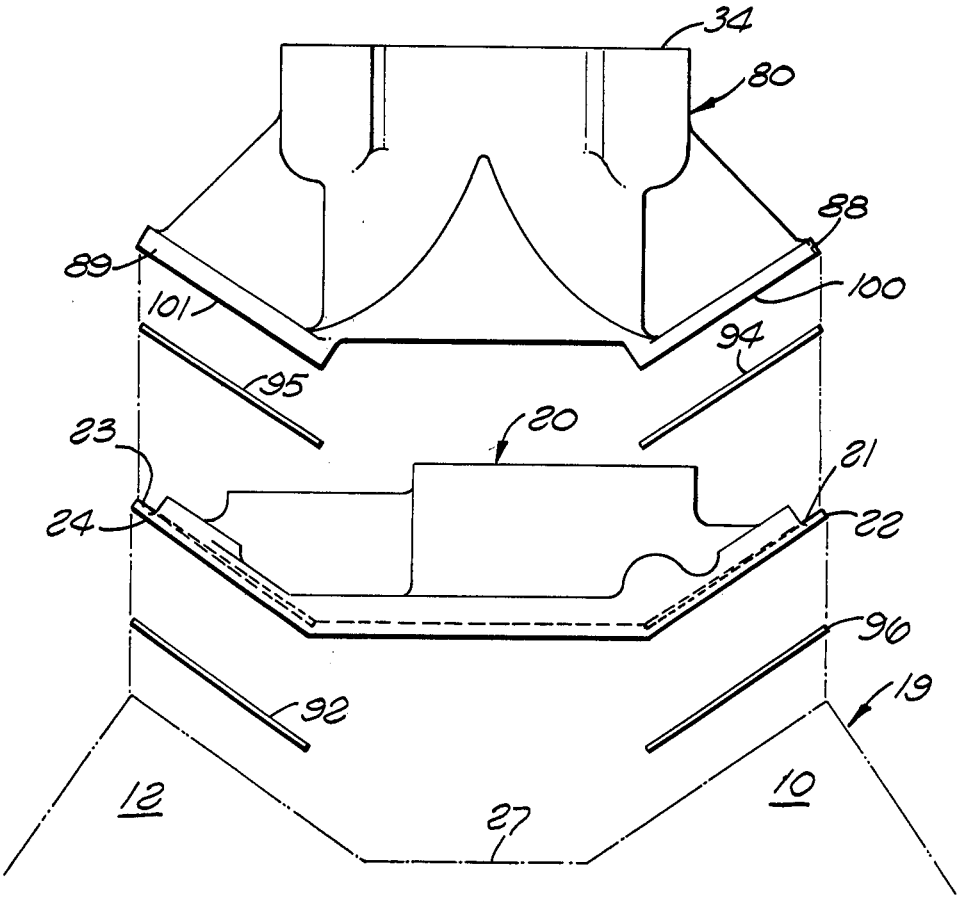
FIG. 4 is an exploded cross-section plan view through Section 4—4 of FIG. 3.

A valley cover section 26 is provided to extend the entire length of the manifold base member 20 between the first angled mounting flange 40 and the second angled mounting flange 44 and between the third angled mounting flange 48 and fourth angled mounting flange 52. As illustrated in FIG. 4, the engine valley cover section extends over and provides a seal for the engine valley 27. It is essential that the engine valley 27 be sealed to prevent exposed engine parts from being contaminated. In addition, oil generally circulates through the engine valley necessitating a sealed closure to prevent oil leakage and to insure the proper operation of crankcase ventilation systems which affect both emissions and efficiency of the engine.

Figure 2:
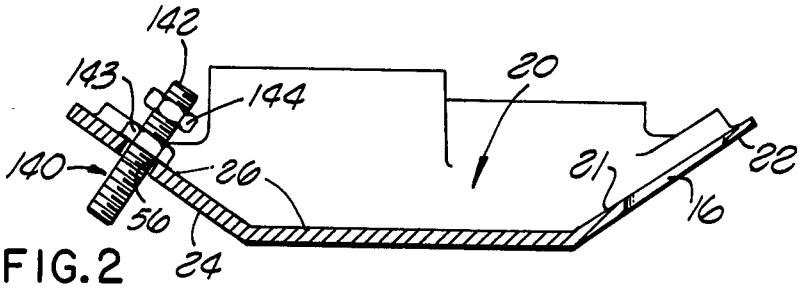
FIG. 2 is a cross-section plan view of the manifold base member of FIG. 1 through Section 2—2.

Referring to FIGS. 1 and 2, the manifold base member 20 also hs a first port flange section 22 with a mating face 21 positioned along the edge of the engine valley cover section 26 between the second angled mounting flange 44 and the fourth angled mounting flange 52. Similarly, a second port flange section 24 with a mating face 23 is positioned adjacent to the engine valley cover section 26 between the first angled mounting flange 40 and the third angled mounting flange 48. It is essential that the first and second port flange sections 22 and 24 be integral with the engine valley cover section 26 and the respective angled mounting flanges 44 and 52 and 40 and 48 respectively. If the port flange sections were not integral with the engine valley cover section and the mounting flanges, then it would be necessary to provide edge sealing between adjoining edges of the base member and the center runner member. Such a seal would require carefully milled edges as well as mating surfaces and would require custom sealing gaskets. Even then, the edge seal would be subject to leakage and could allow contamination into the engine valley.

In the preferred embodiment, the first port flange section 22 and the second port flange section 24 are as thin as possible in view of the structural requirements of the material from which the manifold base member is made so that maximum flexibility can be achieved in providing runner configurations for the center runner member 80 described hereafter. It will of course be appreciated that the more space that is available between the carburetor mounting base of the center runner member and the correponding mating face of the port flange section the more flexibility will exist in configuring the particular runners of the center runner member. In order to achieve this result the port flange section cannot be extensions of or a part of the runners.

In order to provide a manifold base member which may be interchanged with a conventional intake manifold, each port flange section has a plurality of ports to provide communication between the adjacent runner of the center runner member and the adjacent cylinder of the engine. For example, as illustrated in FIG. 1, each port flange section has four ports 16 when the V-block has 8 cylinders. The first port flange section 22 also has two centrally positioned bolt holes 58 and the second port flange section has two central bolt holes 56 through which bolts extend to attach both the center runner member and the manifold base member to the adjacent cylinder bank of the engine.

Figure 3:
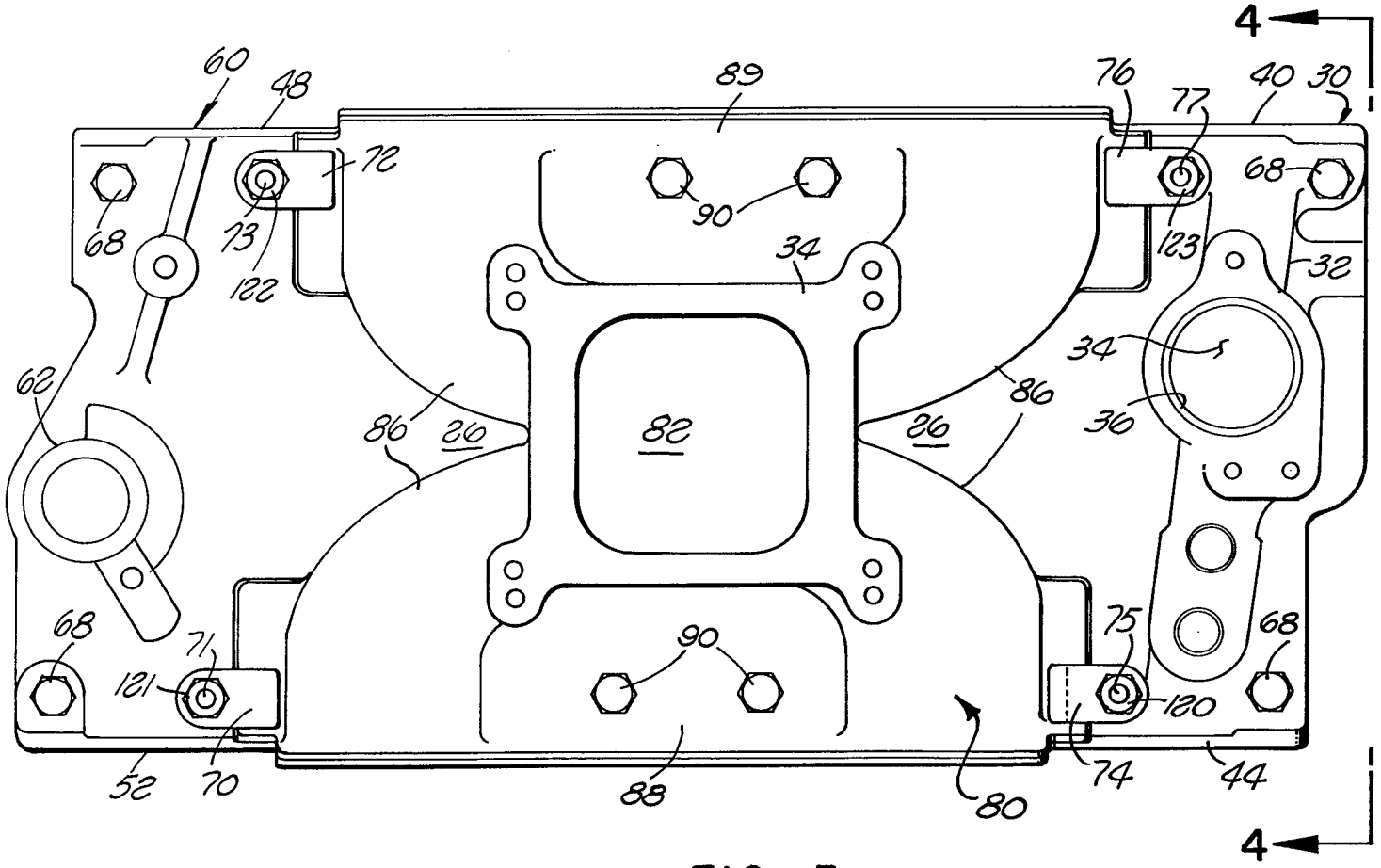
FIG. 3 is a top plan view of an intake manifold assembly in accordance with the present invention illustrating a center runner member attached to the manifold base member illustrated in FIG. 1.

Referring to FIG. 3, a center runner member 80 having an illustrative runner configuration, has a central plenum 82 interconnected to a plurality of runners 86 and opening upward for receiving the fuel air mixture from a carburetor (not shown). The carburetor is mounted on a carburetor mounting base 34. A first runner mating flange 88 at the terminus of the runner on one side of the center runner member 80 then extends outward from the outermost runners and inward between the innermost runners and a second runner mating flange 89 at the terminus of the runners on the other side of the center runner member 80 extends outwardly from the outermost runners and inwardly between the innermost runners. The first and second runner mating flanges 88 and 89 have mating faces 100 and 101 respectively (FIG. 4) which are substantially the reciprocal of the adjacent port flange section 22 and 24 with the runners 86 terminating at the faces 100 and 101 of the respective runner mating flanges 88 and 89.

Referring to FIG. 4 in conjunction with FIG. 3, the center runner member 80 is attached to the manifold base member 20 by simply positioning the mating faces 100 and 101 of the runner mating flanges 88 and 89 adjacent to the corresponding mating faces 21 and 23 of the port flange sections 22 and 24 respectively. Bolts 68 are then inserted through the bolt 41, 45, 50 and 53 holes (FIG. 1) in the manifold base member 20.

Since it is desired to make the manifold base member 20 completely compatible and interchangeable with a stock intake manifold, the portions of the runner mating flanges 88 and 89 extending outwardly from the outer runners do not have a hole through which a bolt can be inserted since the corresponding point on the cylinder bank of the engine will not have a threaded hole to receive the bolt. Consequently, in order to hold the outwardly extending portions of the runner mating flanges 88 and 89 down to effect a complete seal, a straight or L-shaped clamp is provided to be positioned over the edge of the adjacent runner mating flange and held by the nearest adjacent bolt extending through the adjacent angled mounting flange. To assure continuous sealing when the center runner member is removed, the bolts holding the clamps are preferably center hex nut double-ended threaded studs with the clamp being held between a nut on the end of the stud and the center hex portion of the stud. For example, referring to FIG. 2, a center hex nut double-ended threaded stud 140 has a first threaded end 141 inserted into the cylinder bank (not shown), a center hex nut 143, a second top threaded end 142 and a nut 143. A clamp to be described hereafter is then held by the nut 144 between the center hex nut 143 and the nut 144.

Specifically, a first clamp member 74 is provided with a hole in one of its ends through which a stud 75 passes. The stud 75 is inserted through the hole 46 (FIG. 1) and is screwed into the adjacent threaded hole in the cylinder bank of the engine. The opposite end of the clamp, which may for example have an L-shaped portion extending downward therefrom, is then placed over the stud 75 against the hex portion thereof (not shown) with its other end positioned over the outwardly extending portion of the runner mating flange 88. Thus, when a nut 120 is screwed onto the stud 75, the clamp 74 will force the outwardly extending edge portion of the runner mating flange 88 against the mating surface 21 of the port flange section 22. In a similar manner, the clamps 70, 72 and 76 are attached by the studs 71, 73 and 77 and nuts 121, 122 and 123 respectively to the adjacent angled mounting flange 52, 48 and 40 to thereby hold the outwardly extending ends of the runner mating flanges 88 and 89. The center of the center runner member is attached by bolts 90 which pass through holes in the center runner member, the aligned holes 56 and 58 in the port flange section of the base member (FIG. 1) and screw into the engine block assembly.

Referring to FIG. 4, an exploded view of the assembly as shown in FIG. 3 through section 4—4 is illustrated. Specifically, the manifold base member 20 is attached to a V-shaped engine block assembly 19 with the first port flange section 22 attached to a first cylinder bank assembly 10 with a gasket 96 therebetween.

Similarly, the second port flange section 24 is attached to a second cylinder bank assembly 12 with a second gasket 92 therebetween. Third gasket 94 and fourth gasket 95 are positioned between the upper mating faces 21 and 23 of the port flanges sections 22 and 24 and the adjacent mating faces 100 and 101 of the runner mating flanges 88 and 89 respectively. The center runner member 80 and the manifold base member 20 are then held to the engine block assembly 19 using bolts in a conventional manner.

In order to interchange the center runner member with a new center runner member, it is merely necessary to follow the procedure of removing the bolts 90; loosening or removing the nuts 120, 121, 122 and 123; rotating or removing the clamps 70, 72, 74, and 76 from the studs 71, 73, 75 and 77 so that the clamps are not holding the edge portions of the runner mating flanges 88 and 89; and either removing the carburetor from the carburetor mounting base or alternatively disconnecting the mechanical carburetor linkages and the fuel line for later reconnection to another carburetor on another carburetor mounting base of a second center runner member. A new center runner member may then be mounted by replacing the bolts 90 in the appropriate holes; replacing the clamps 70, 72, 74 and 76 to a position over the adjacent edge portions of the runner mating flanges 88 and 89 and tightening the nuts 120, 121, 122, and 123; and finally reconnecting the carburetor linkage and fuel line.

In following the above procedure for replacing the center runner member, the manifold base member remains in place with the coolant crossover seals and the engine valley cover section seals and the engine timing intact and undisturbed. Hence, it is clear that utilizing the novel apparatus of the present invention, interchangeable center runner members may be provided and interchanged quickly and easily without disturbing seals unrelated to the runner and carburetor interconnections and without disturbing the engine timing.

While a particular embodiment of the invention has been shown and described, it will be obvious to those skilled in the art that changes and modifications may be made without departing from the invention and its broader aspects and therefore the aim in the appended claims is to cover all such changes and modifications as fall within the true spirit and scope of the invention.

What is claimed is:

1. An intake manifold assembly for replacing a stock intake manifold on an engine having a V-shaped engine block with dual cylinder banks each having a cylinder bank mating surface with a plurality of ports therein, the engine having an engine valley between the dual cylinder banks, the intake manifold assembly comprising:

at least one removable center runner member having a carburetor mount, comprising:

first manifold runner means having a first runner mating flange remote from the carburetor mount, with communicating runner ports therethrough, second manifold runner means having a second runner mating flange remote from the carburetor mount with communicating runner ports therethrough;

a manifold base member integrally having:

a coolant crossover section at one end, a distributor boss section at a second end, an engine valley cover section between the coolant crossover section and the distributor boss section, and a pair of port flanges on the opposite sides of the engine valley cover section between the coolant crossover section and the distributor boss section, each having a top mating face, the manifold base member further having a continuous bottom mating face for being positioned and held against the cylinder bank mating surfaces for interconnecting the coolant crossover section to the engine block and enclosing the engine valley, the first and second runner mating flanges of the center runner member being positioned and held adjacent one of the top mating faces of the manifold base member, whereby one center runner member can be replaced by second center runner member without removing the manifold base member.

2. The intake manifold assembly of claim 1, the manifold base member further having a coolant crossover duct through the coolant crossover section, the intake manifold assembly further comprising for each bottom mating face:

first bolt means extending through the manifold base member and positioned between the coolant crossover duct and the adjacent runner mating flange;

second bolt means extending through the manifold base sections of the manifold base member and positioned adjacent the runner mating flange;

first clamp means positioned over one edge of the runner mating flange and held by the first bolt means; and second clamp means positioned over the other edge of the runner mating flange opposite the one edge and held by the second bolt means.

3. The intake manifold assembly of claim 1 or 2 wherein the port flanges of the manifold base member have a thickness no greater than the thickness of the coolant crossover, the distributor boss or the engine valley cover sections of the manifold base member.

4. The intake manifold assembly of claim 1 or 2 further comprising a pair of first gaskets one for being positioned between each port flange and the adjacent center runner member first or second runner mating flange.

5. The intake manifold assembly of claim 4 further comprising a pair of second gaskets, each positioned between the manifold base member bottom mating face and the adjacent cylinder bank mating surface.

6. The intake manifold assembly of claim 2, the first and second bolt means each further comprising:

a center hex nut double-ended threaded stud; and a nut, the clamp being positioned between the center hex nut portion of the threaded stud and the nut for being held immovable in a clamping configuration by the nut.

* * * * *